US006042025A

United States Patent [19]

Crampton et al.

[11] Patent Number: 6,042,025

[45] Date of Patent: Mar. 28, 2000

[54] TWO HOLE DISPENSER WITH BAFFLES

[75] Inventors: David C. Crampton, Fountain Valley, Calif.; Robert Smith, Ballwin, Mo.

[73] Assignee: Smith et al., St. Clair, Mo.

[21] Appl. No.: 09/039,359

[22] Filed: Mar. 13, 1998

[51] Int. Cl.[7] ..... B05B 1/26; B05B 7/04

[52] U.S. Cl. ..... 239/337; 239/432; 239/543

[58] Field of Search ..... 239/543–545, 239/432, 337

[56] References Cited

U.S. PATENT DOCUMENTS

| | | | |
|---|---|---|---|
| Re. 30,486 | 1/1981 | Beck | 239/544 X |
| 4,453,670 | 6/1984 | Sivory | 239/432 X |
| 4,828,181 | 5/1989 | Singles-Craenen | 239/432 X |
| 4,972,995 | 11/1990 | Schara et al. | 239/432 X |

*Primary Examiner*—Kevin Weldon
*Attorney, Agent, or Firm*—James A. Quinton, Esq.

[57] ABSTRACT

A multiple hole, preferably a two hole spray dispensing system and sprayer in which colliding streams of viscous fluid are dispensed to the atmosphere are provided. The spray dispenser includes a reservoir for storing a fluid product. An aerosol or manually pressurized dispensing system preferably a hand held dispensing system may be used. Liquid is delivered from the reservoir under pressure to a delivery passageway. A nozzle having two or more outlets to the atmosphere is mounted to the delivery passageway to provide colliding streams of liquid. Baffles are provided to disrupt the flow of liquid in the stream prior to the collision of the streams to provide an improved spray pattern.

30 Claims, 9 Drawing Sheets

TWO HOLE DISPENSER WITH BAFFLES

TECHNICAL FIELD

The field of the invention is a dispensing system for high viscosity fluid products. More particularly, the present invention provides an improved hand held spray dispenser which has a nozzle having two or more outlets for delivering fluid on colliding paths.

BACKGROUND ART

Highly viscous fluids have posed a dispensing problem in the art. Vegetable oil containing products have been particularly troublesome. Considerable efforts have been made to provide spray dispensable viscous vegetable oil compositions. These compositions may contain other viscous vegetable oil based products such as lecithin and may contain suspended solids. These products have been dispensed in aerosol form, generally using a propellant which will mix with the viscous vegetable oil and reduce the viscosity. This has resulted in the use of chlorofluorohydrocarbons (CFCs) propellant. Alternatively, volatile organic compounds (VOCs) such as isobutane or propane have been used. Such propellants are now considered environmentally unacceptable. Pump sprayable dispensing systems for viscous vegetable oil have also generally required dilution of the vegetable oil to reduce its viscosity.

Pump sprayable dispensing systems for viscous liquids have consequently been developed. For example, U.S. Pat. No. 5,088,649 describes a colliding stream hand pump sprayer which can dispense a fine spray of viscous liquids without the need for using diluents.

Aerosol containers also have been described in the prior art having colliding streams which improve the break up of viscous fluid. For example, U.S. Pat. No. 5,249,747 describes such a system which uses compressed gases as propellants instead of a CFC or VOC propellant. However, the quantity of liquid product dispensed and the quality of the spray pattern are important. In the prior art, there can be uneven distribution of the viscous liquid and undesirable heavy concentration areas from the colliding stream sprayers.

Accordingly, it would be desirable to provide a hand held dispensing system for viscous liquids which would provide an improved spray pattern which would reduce the undesirable concentration of product and provide for more even distribution.

DISCLOSURE OF THE INVENTION

The present invention relates to an improved viscous fluid dispensing system. The invention also relates to an apparatus for dispensing viscous fluids without the need to use diluents or VOC or CFC propellants.

It is an object of the invention to provide a multiorificed viscous fluid dispensing system having colliding streams which can dispense viscous liquids in a fine mist.

It is an object of the invention to provide an aerosol dispensing system which can use compressed gases such as nitrogen, carbon dioxide, nitrous oxide or a noble gas as propellant, while still providing a finely atomized product. Compressed gases as denoted by the aerosol industry are defined as a gas that can be liquified only by the application of very low temperatures or very high pressure. Compressed gases include carbon dioxide, nitrous oxide and nitrogen. Freon, butane, and pentane are not considered compressed gas propellants.

It is an object of the invention to provide a viscous fluid dispensing system which provides a uniform fine spray and which has minimal areas of heavy concentration of liquid.

It is an object of the invention to provide a two hole spray dispensing system with intersecting outlet streams having an improved break up and reduced high concentration spots in the liquid spray.

Other further objects will become apparent from the specification drawings and claim.

According to the invention, a multiple hole, preferably a two hole spray dispensing system and a sprayer in which colliding streams of viscous fluid preferably a viscous liquid are dispensed to the atmosphere are provided. The spray dispenser according to the invention includes a reservoir for storing a fluid product. An aerosol or manually pressurized dispensing system preferably a hand held dispensing system may be used. Liquid is delivered from the reservoir under pressure to a delivery passageway. A nozzle having two or more outlets to the atmosphere is mounted to the delivery passageway to provide two streams of fluid which collide at a collision location exterior to the nozzle outlets. In a colliding stream sprayer, viscous liquids exiting the orifices in the spray dispenser tend to exit in streams instead of a fine mist. Such streams maintain substantial stream integrity that is the viscous fluid tends to discharge from the orifice of the spray dispenser as streams of fluid prior to the collision of the streams at the collision location.

According to the invention, one or more viscous liquid baffles are provided which extends across a part of one or more of the streams to disrupt the flow of viscous fluid prior to the collision of the streams at a collision location or point. Preferably the baffle is located adjacent to an outside edge of the discharging fluid stream prior to the collision location to impart increase turbulence within the stream. The viscous fluid streams collide after having encountered one or more of the baffles. Desirably the width of the stream is increased and/or the turbulence of the viscous fluid is enhanced prior to the collision point or location. Thus, the stream integrity of one or more of the discharge steams is compromised, as a result wider, more turbulent streams collide at the collision location. The spray produced has a smaller particle size, more even distribution of product within the spray, a finer mist and reduced area of concentrated particles (hot spots) than encountered in a multi-hole sprayer which has no baffles. Preferably all the streams exiting from the multihole nozzle are disrupted by one or more baffles which are desirably positioned at the periphery of each stream. Optionally two or more baffles or deflectors are provided so that each stream is in communication with two spaced baffles on opposite sides of streams. The viscous fluid exiting from one orifice collides at a preselected collision location with the viscous fluid exiting from the other orifice. As a result, the dispensing system delivers viscous fluids or liquids in a fine mist with even distribution of product and a reduction in the areas of undesirable high concentration hot spots.

The preferred embodiment of the present invention is illustrated in the drawings and examples. However, it should be expressly understood that the present invention should not be limited solely to the illustrative embodiment.

DETAILED DESCRIPTION OF THE INVENTION

Figure 1:
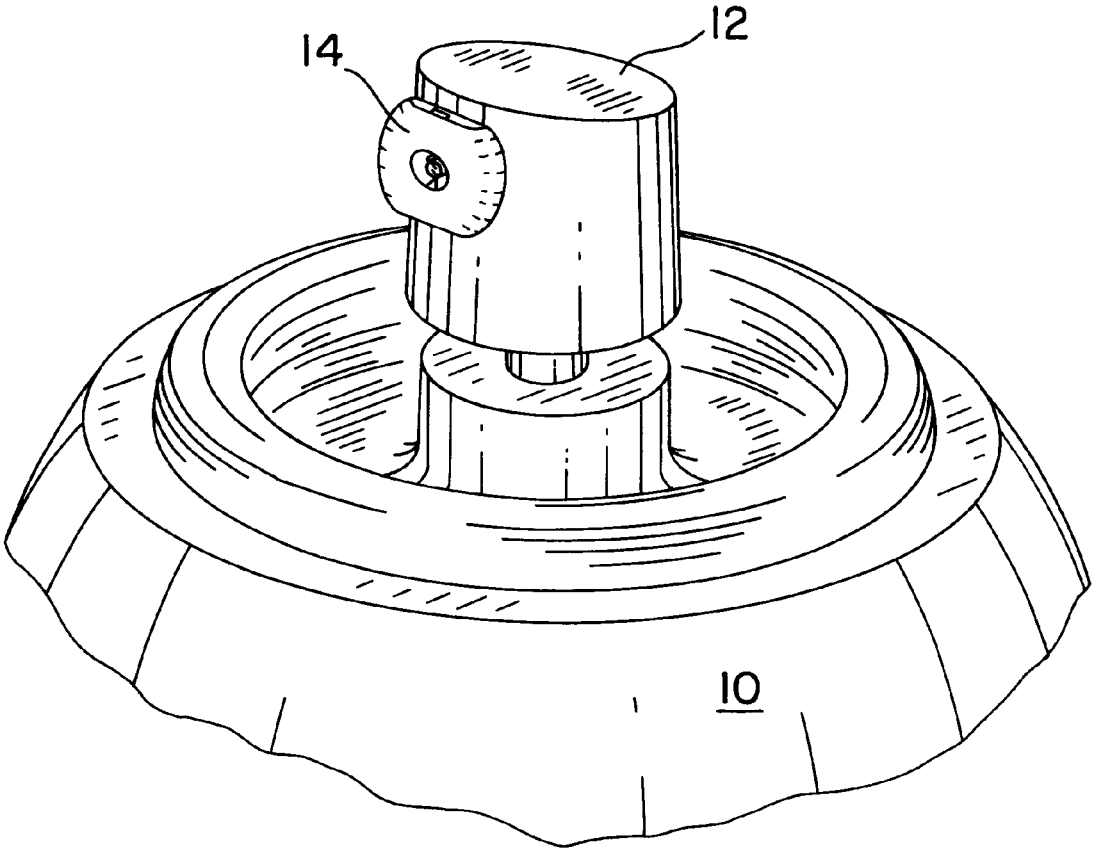
FIG. 1 is a partial perspective view of a spray dispenser according to the invention.

According to the invention, a multiple hole, preferably a two hole spray dispensing system and a sprayer in which colliding streams of viscous fluid are dispensed to the atmosphere are provided. The spray dispenser according to the invention includes a reservoir for storing a viscous liquid product. An aerosol or manually pressurized dispensing system preferably a hand held dispensing system may be used to draw fluid preferably liquid from the reservoir. The fluid is delivered from the reservoir under pressure to a delivery passageway. A nozzle preferably a molded nozzle having two or more outlets to the atmosphere is mounted to the delivery passageway to provide colliding stream of fluid. Viscous fluids or liquids can be difficult to atomize in a fine mist. Viscous liquids exiting typical colliding sprayers of the prior art tends to flow in streams of liquid. Such streams maintain substantial stream integrity prior to their collision with one another. According to the invention, it has been found that an improved spray pattern can be obtained from a colliding stream sprayer if the flow in one or more of the streams are disrupted prior to the collision of the streams. According to the invention, one or more viscous fluid baffle extends across a part of one or more of the colliding streams exiting from the multiple outlets of the nozzle prior to the collision of the colliding streams. Optionally two baffles extend across a part of each stream. The baffles are preferable directly attached to the nozzle. Optionally a single piece molded nozzle having integral baffles is provided. According to the invention one or more baffles are located adjacent to an edge of the discharging liquid streams between the collision point of the stream and the nozzle outlets. The viscous liquid streams collide after having encountered one or more baffles.

In another aspect of the invention, a dispensing system for spraying viscous liquids is provided. The dispensing system according to the invention delivers viscous fluids and liquids in a fine mist with improved distribution and a reduction in the areas of undesirable high concentration spots.

Preferably, the fluid to be sprayed is a highly viscous fluid desirably a liquid, having a viscosity of above 60 cps, preferably from 60 cps to 200 cps, most preferably from 70 cps to 150 cps. The spray dispensing system according to the invention is useful with numerous different systems for delivery of pressurized liquid to a delivery passageway. A hand held spray dispenser such as an aerosol, a hand pump sprayer such as a finger pump sprayer and a trigger sprayer can be used. Optionally, a bladder type sprayer can be used.

Many different types of viscous liquids can be dispensed in a fine mist in the spray dispensing system according to the invention. Viscous organic liquids, particularly vegetable oil and/or vegetable oil, lecithin compositions are particularly useful. Such products generally have a viscosity of greater than about 60 cps and above, and are considered difficult to spray dispense. The viscous fluid desirably has a viscosity of above about 60 cps and preferably from 70 to 150 cps. The viscous fluid is preferably a vegetable oil based cooking oil or pan coating which may contain solids suspended in the vegetable oil. Such products often include stabilizers and additives. Desirably, the viscosity of the fluid is from about 60 cps to about 200 cps, desirably from about 70 cps to about 150 cps and alternatively from about 80 cps to about 120 cps. Additionally, other viscous liquids may be used such as paint pigments in linseed oil, viscous petroleum products, lubricants, adhesives and/or resins. Resins include hairspray and other viscous resins.

According to the invention a spray dispenser for dispensing and atomizing a viscous fluid is provided. The spray dispenser may be an aerosol dispenser, bladder type dispenser, a hand pump dispenser for example a hand pump dispenser of the trigger type or a finger pump dispenser. According to the invention the spray dispenser is designed for dispensing and atomizing a viscous fluid preferably a liquid. The dispenser includes a reservoir for storing a liquid. A delivery means for providing a viscous liquid under pressure from the reservoir to a delivery passageway is provided. A multiorifice nozzle having a first and second nozzle outlet is provided across the delivery passageway for providing streams of a viscous liquid. One or more viscous fluid baffles are provided. The baffles extend across one or more of the exiting viscous fluid streams to disrupt a portion of the flow of the viscous fluid. The streams of the viscous fluid collide with one another after disruption by the baffle.

Figure 2A:
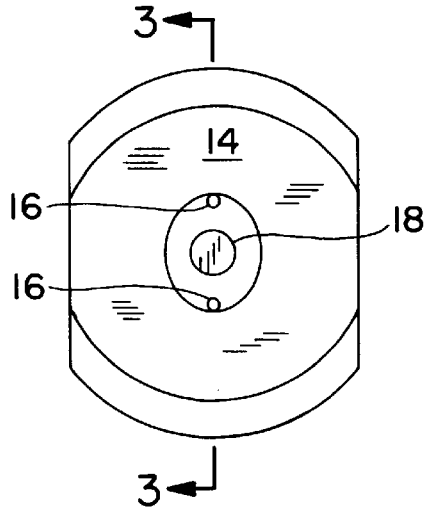
FIG. 2A is a front view of the aerosol nozzle insert of FIG. 1.
Figure 2B:
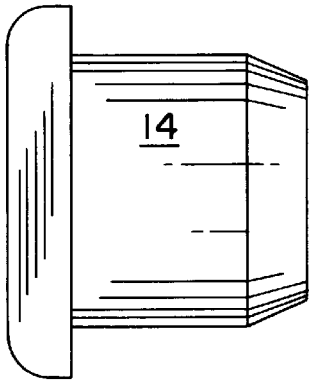
FIG. 2B is a side view of the aerosol nozzle insert of FIG. 2A.
Figure 3:
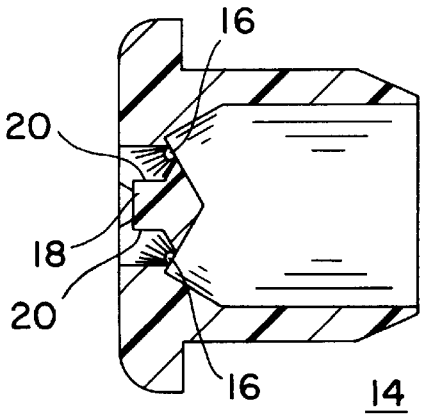
FIG. 3 is a sectional view through 3—3 of FIG. 2A.
Figure 12:
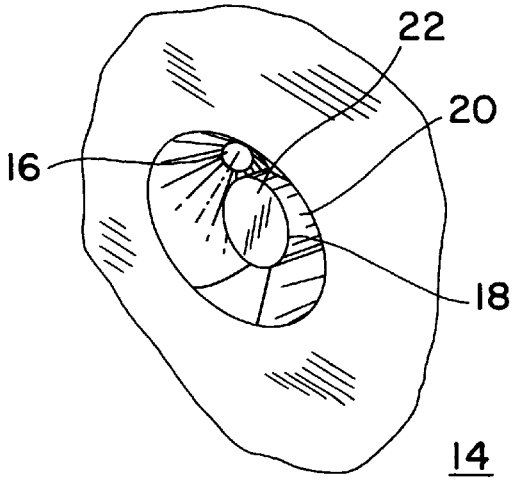
FIG. 12 is an expanded partial section view of FIG. 1 showing the baffle according to the invention.

As best seen in FIGS. 1 through 2A, 3 and 10, an aerosol dispenser 10 is provided having an actuator 12 and actuator insert 14. A multiple orificed nozzle insert 14 is provided having two or more orifices 16 preferably as best seen in FIG. 2A and 3 two orifices 16. A baffle platform 18 is provided. A portion of the baffle platform extends into and disrupts the flow of a portion of the viscous fluid flowing from at least one of the orifices 16 in actuator insert 14. Preferably one or more areas on surface 20 of the baffle platform 18 disrupts the fluid flow in a portion of streams 24 and 26 flowing from orifices 16. As shown in FIGS. 2A and 3, the baffle platform 18 is desirably a cylindrical post. Optionally the baffle platform 18 can be provided in a variety of other shapes such as square, elliptical, hexagonal or octagonal. A surface of the baffle platform extends into at least one of the fluid flowing streams 24 and 26 exiting from at least one of the orifices 16. Preferably surface 20 of baffle platform 18 extends into the exiting stream 24 on one side of the baffle platform and extends into stream 26 on the opposite side of the baffle platform 18 to disrupt the flowing fluid from both stream 24 and 26. Surface 20, of the baffle platform 18, is desiraly a cylindrical surface. As best seen in FIG. 12, the front of the baffle platform 18 includes a front deflector surface 22 which in part cooperates with surface 20 to disrupt the streams 24 and 26. As shown in FIG. 2A and FIG. 12 the front deflector surface 22 can be circular. Optionally other shapes eg., square, faceted, diamond, gear and/or, elliptical shapes can be provided which will affect the resulting spray pattern.

Figure 10:
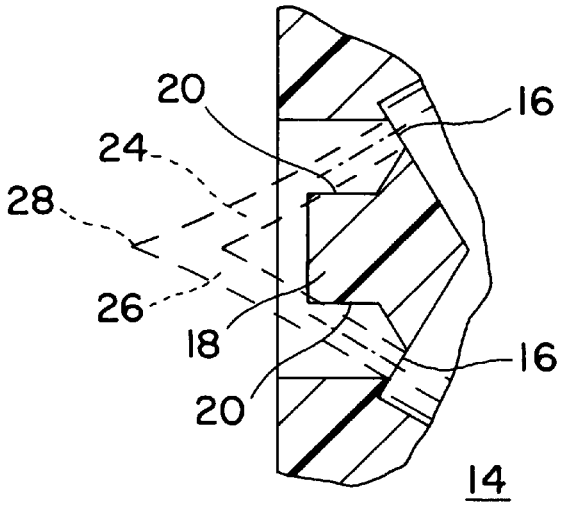
FIG. 10 is expanded partial sectional view of FIG. 3 showing the fluid flow streams.

In operation as best seen in FIG. 10 pressurized viscous liquid is discharged through orifices 16 from aerosol container 10. The viscous liquid discharging from orifices 16 exit in streams along flow paths 24 and 26. At least one of streams 24, 26 is disrupted by baffle surface 20 preferably provided by baffle platform 18. Preferably both streams 24 and 26 are disrupted by baffle surface 20. The flowpath of the viscous fluid is disrupted by baffle surface 20 provided by baffle platform 18. The viscous fluid flowing in streams 24 and 26 in part collide with the baffle surface 20 of baffle platform 18 causing turbulence in one or more of streams 24 and 26. As a result when the streams subsequently intersect, a greater breakup of the viscous liquid is achieved. In addition, the problematic hotspots which can be encountered in a two hole sprayer are reduced.

Figure 4:
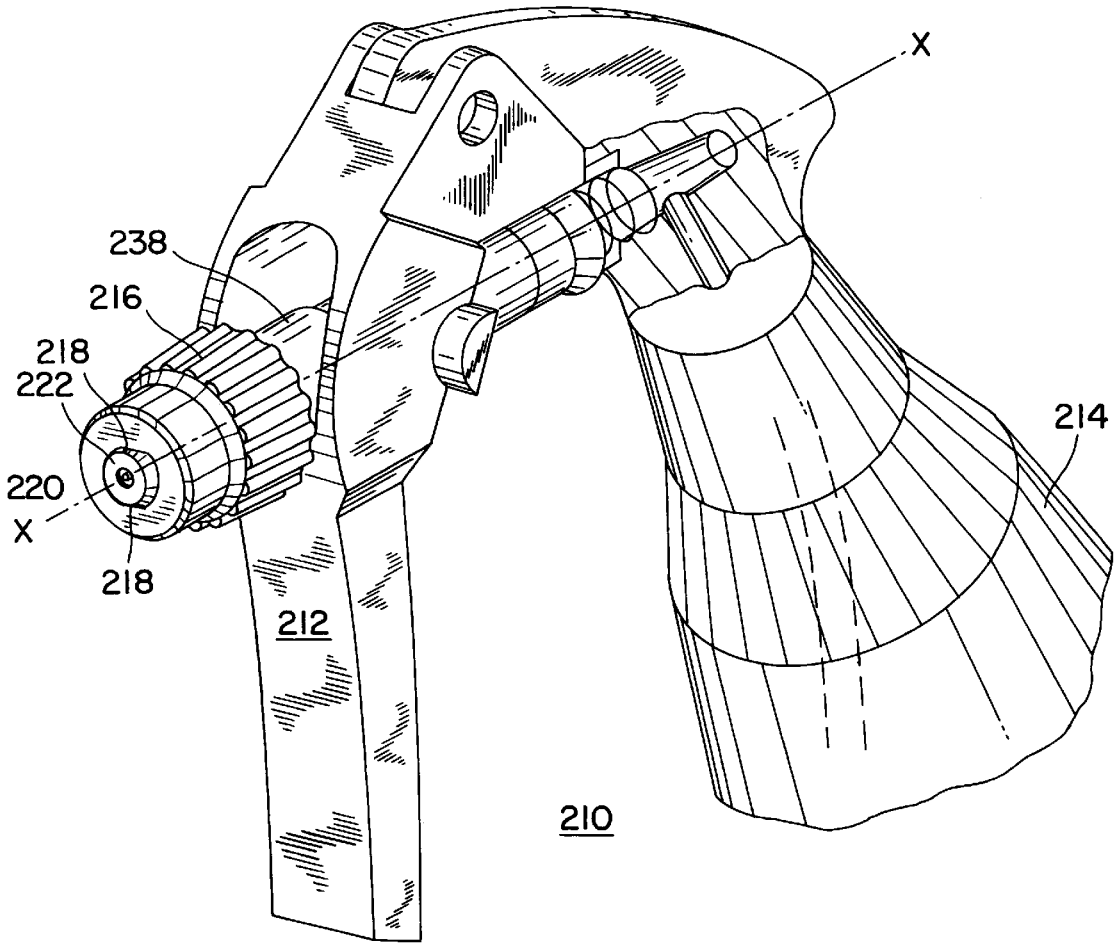
FIG. 4 is a partial perspective view of an alternative embodiment of the spray dispenser according to the invention.
Figure 5:
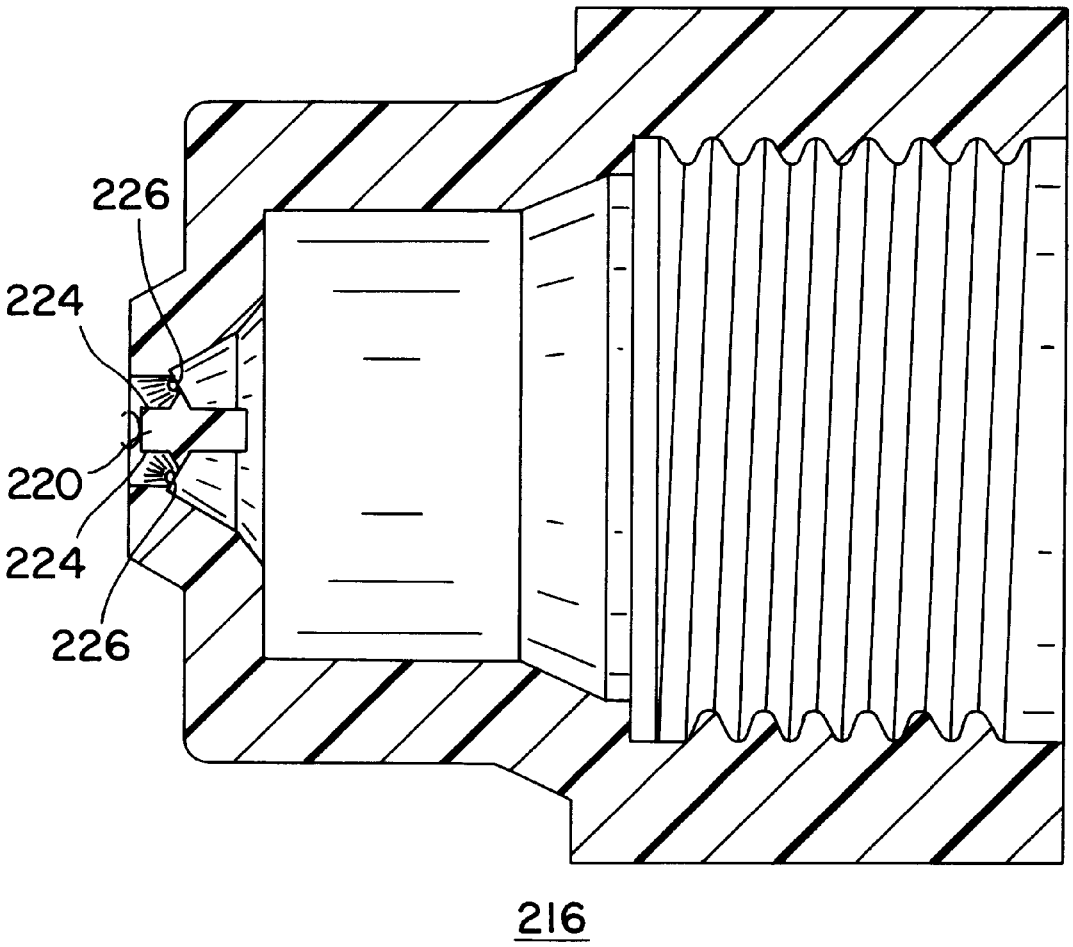
FIG. 5 is a sectional view through x—x of FIG. 4.
Figure 6A:
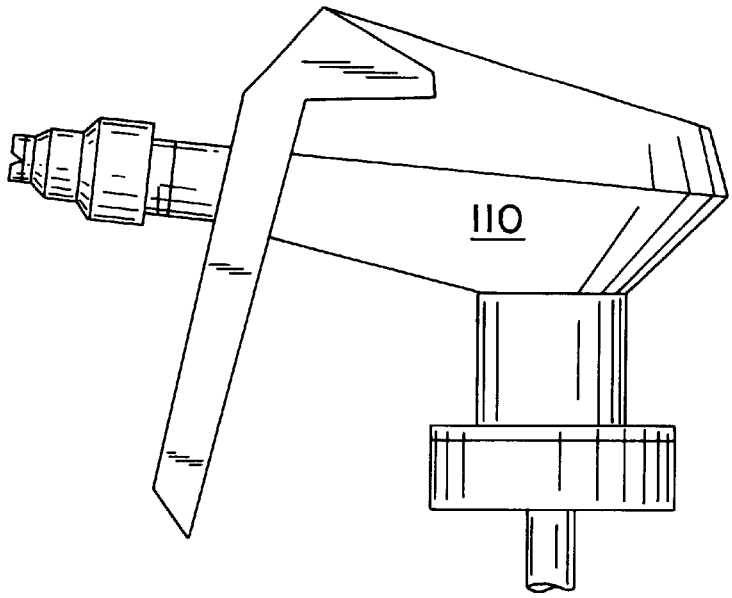
FIG. 6A is a perspective view of an alternative embodiment of the spray dispenser according to the invention.
Figure 6B:
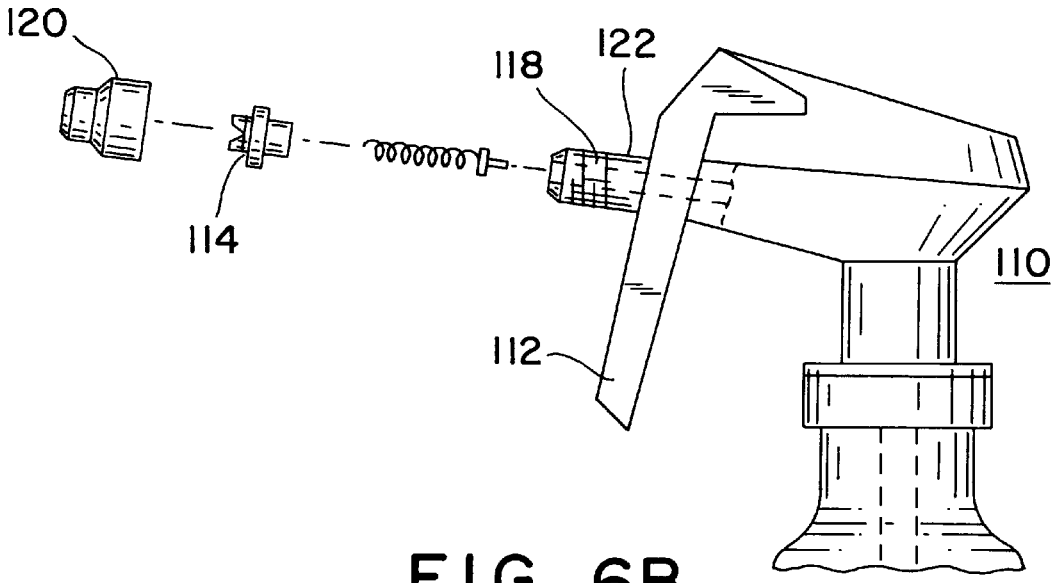
FIG. 6B is an exploded view of FIG. 6A.
Figure 7A:
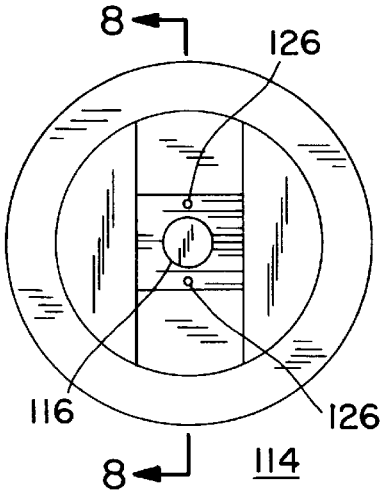
FIG. 7A is a front view of the nozzle insert of the spray dispenser of FIG. 6.
Figure 7B:
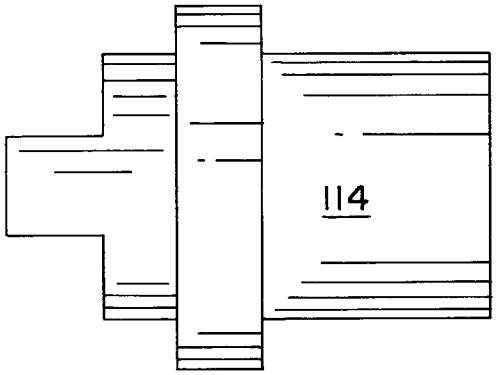
FIG. 7B is a side view of nozzle insert of 7A.

In another aspect of the invention, a hand held manually activated spray dispenser and system is provided with a baffle for improving the breakup of a two hole dispensing system. The sprayer and system can include a molded nozzle having a molded integral baffle platform or a nozzle in which the baffle platform is pressure fitted in a space provided in the nozzle. As best seen in FIGS. 4 through 5, a manual activated hand pump sprayer according to the invention is provided. Hand pump sprayer 210 of the trigger type having a trigger 212 and a reservoir 214 is provided. The hand pump sprayer includes a nozzle 216 which desirably includes nozzle flats 218. A baffle platform 220 is provided. The baffle platform 220 having baffle surfaces 224 is centrally located within the nozzle to disrupt a portion of fluid exiting from the nozzle preferably a viscous fluid exiting from nozzle orifices 226. The baffle surface 224 disrupts the fluid flow in at least one of the streams exiting from orifices 226 as best seen in FIG. 5. FIG. 5 is a section through x—x of nozzle 216 of FIG. 4. Preferably the baffle platform surface 224 disrupts the flow from both orifices 226. Prior to the intersection of the fluid streams exiting from 226, the baffle platform surface 224 disrupts the flow in the fluid stream. As a result of the disruption of the fluid streams exiting from orifices 226, additional turbulence is introduced into the exiting streams. As a result, after the streams have collided at a point exterior to the nozzle, the spray produced has a desirable small particle size, a more uniform distribution of product within the spray, a finer mist and a reduced area of concentrated particles (hotspots) than is encountered without the baffle platform.

Figure 8:
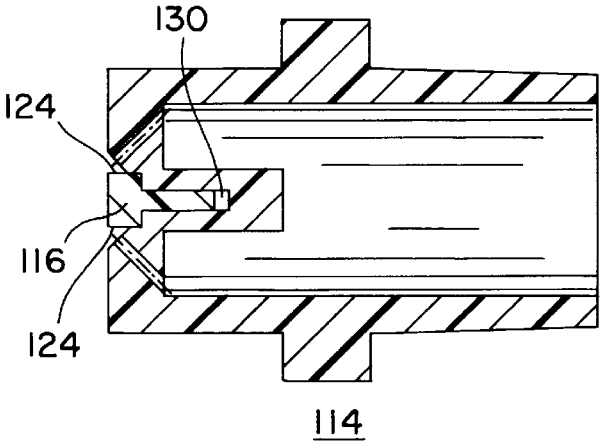
FIG. 8 is a sectional view through 8—8 of 7A.
Figure 9:
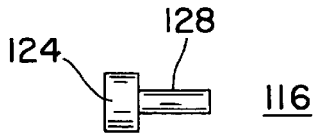
FIG. 9 is a side view of the baffle of FIG. 8.

FIGS. 6 through 9 show an alternative embodiment of a hand pump sprayer according to the invention. Referring to FIG. 6B which is an exploded view of FIG. 6A, a hand pump sprayer 110 of the trigger type is provided. The sprayer includes trigger 112 and nozzle insert 114. A baffle platform 116 including post 128 desirably a cylindrical post is provided for friction fit in cylindrical recess 130 as best seen in FIG. 8. Desirably a threaded nozzle cap 120 is provided for receipt and securing nozzle insert 114 to the hand pump sprayer 110. Desirably a threaded cap 120 is secured to threaded plunger 122. As shown in FIG. 9, baffle platform 116 desirably includes baffle surfaces 124 and cylindrical projection 128. The cylindrical projection mates with cylindrical recess 130 for friction fit into nozzle insert 114.

In operation fluid is brought through fluid passageway 118 under pressure to nozzle orifices 126 when the trigger 112 is pulled. The fluid exits nozzle orifices 126 in defined viscous fluid streams. Preferably the viscous liquid is on a predetermined path for intersection of the streams at a point after the viscous liquid has exited the orifices 126. Prior to the intersection of the viscous liquid streams at least a portion of one of the viscous liquid streams is disrupted by contacting baffle platform surface 124 which acts as a baffle. Preferably both streams contact the baffle platform surface 124 and both streams are partially disputed by contacting the surface. Preferably only a portion of each stream comes in contact with the baffle platform 116. Subsequent to the disruption of the streams by the baffle surface 124 of the baffle platform 116, the streams collide. The spray produced has a resulting smaller particle size, a more even distribution of product within the spray, a finer mist and a reduced area of concentrated particles (hotspots) then would be encountered without use of the baffle platform. It is preferred that the streams from orifices 126 are on a predetermined path for intersection prior to encountering to baffle platform 116. Optionally, the baffle platform 116 can be positioned to disrupt the fluid flow paths such that they will ultimately be on a collision course.

Figure 11A:
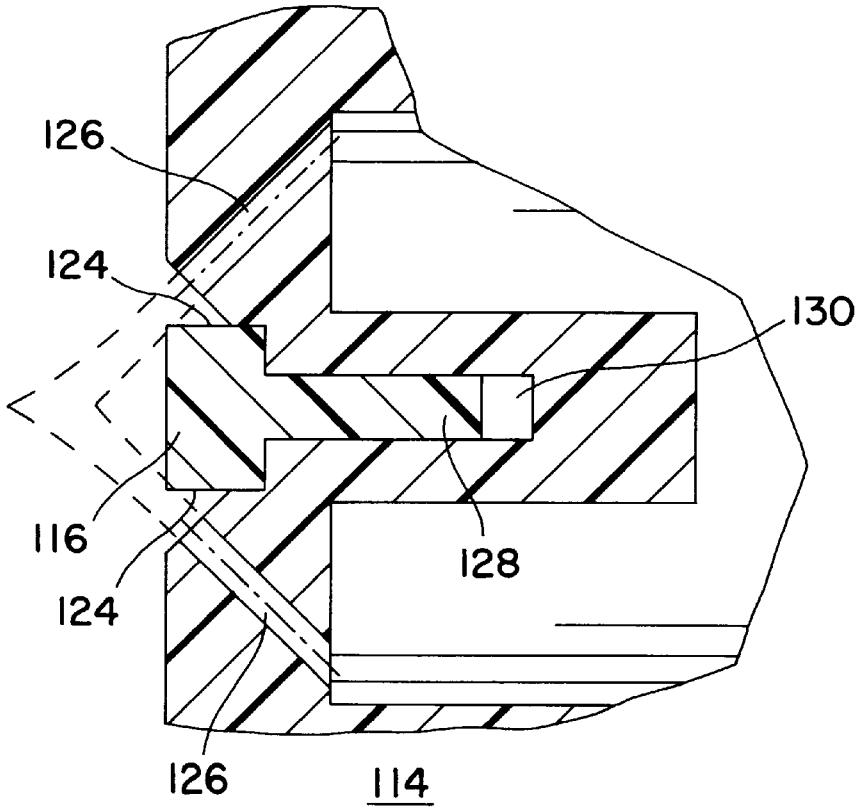
FIG. 11A is an expanded partial sectional view of FIG. 8 showing the fluid flow streams.
Figure 11B:
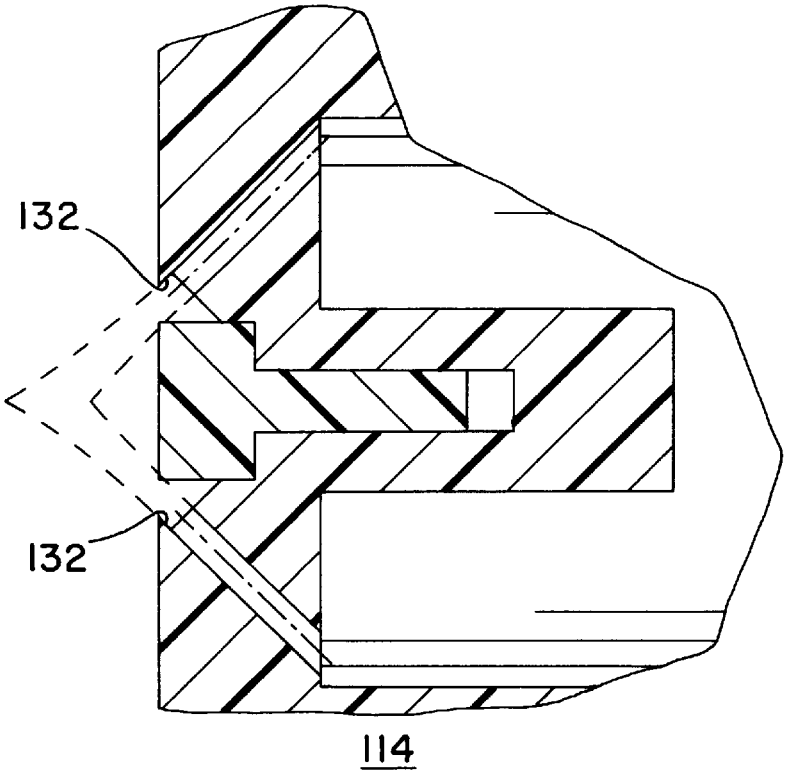
FIG. 11B is an alternative expanded partial sectional view of an alternative embodiment showing the fluid flow streams.

Referring now to FIGS. 10, 11A and 11B, FIG. 10 is an expanded cutaway of FIG. 3 showing the fluid flow streams. Fluid exits orifices 16 and flows in predetermined flow paths 24 and 28 as shown in FIG. 10. A portion of the flow path intersects with baffle platform 18 wherein the flow of the fluid is disrupted. Ultimately the viscous fluid flowing along the fluid flow paths 24 and 26 collides at a collision location 28. As a result an improved spray pattern is provided in which the resulting spray has a smaller particle size, a more even distribution of product, a finer mist and a reduced area of concentration of particles (hotspots) than is encountered without use of the baffles. Similar to FIG. 10, FIG. 11A is a cutaway of FIG. 8 which relates to the hand pump sprayer of FIG. 6A. In FIG. 11A a baffle platform 116 with cylindrical projection 128, is provided for friction fit in recess 130. The viscous liquid exits orifices 126 and is disrupted by the baffles surfaces 124 of baffle platform 116. The disrupted fluid streams then collide at a point after the disruption by the baffle platform 116 to provide an improved spray pattern as discussed above. FIG. 11B shows a further embodiment showing a alternative nozzle insert having deflector baffles 132 on opposed sides of nozzle insert 114 which will disrupt the fluid flowing from orifices 126. Optionally, baffle platform 116 will be also provided so that the exiting viscous liquid is deflected on both sides of both of the streams. That is that both streams are deflected on opposite sides.

Figure 13:
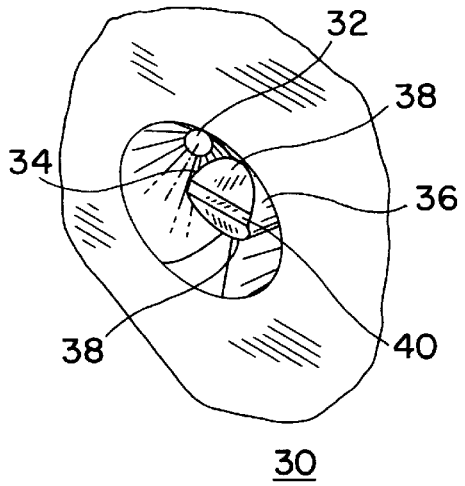
FIG. 13 is an alterative embodiment of the baffle platform according to the invention.
Figure 14:
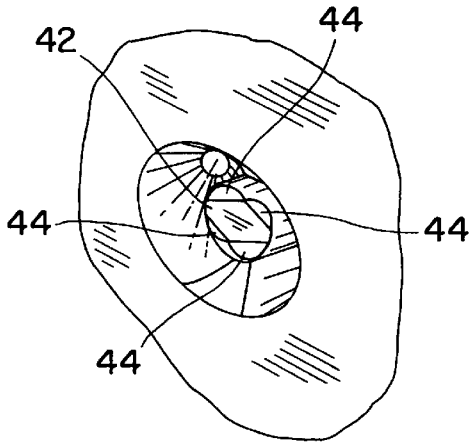
FIG. 14 is an alternative embodiment of the baffle platform according to the invention.
Figure 15:
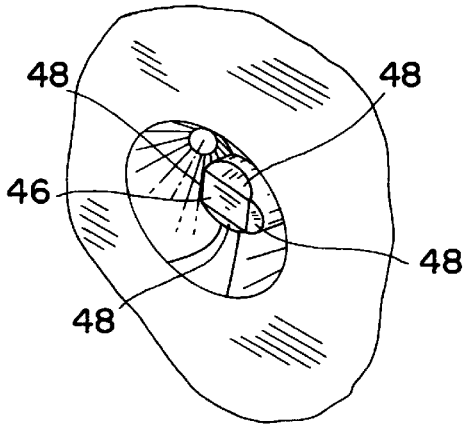
FIG. 15 is an alternative embodiment of the baffle platform according to the invention.
Figure 16:
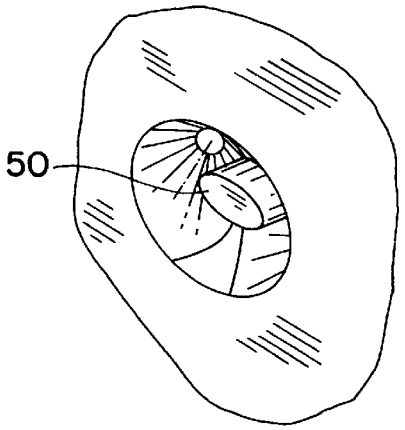
FIG. 16 is an alternative embodiment of the baffle platform according to the invention.

As best seen in FIGS. 12 through 16, the front face and the shape of the baffle platform can be varied and still come in with the scope of the invention. For example, as shown in FIG. 12 a cylindrical baffle platform 18 is provided having circular flat front face 22. Alternatively as shown in FIG. 13 a baffle platform 34 having a sloping front face is provided. In FIG. 13 two sloping faces 38 are provided which are joined together in the front by a flat surface 40. Optionally flat surface 40 could be made in other shapes, for example the surfaces could be joined together in a point or line eliminating the flat surface. Optionally, as shown in FIG. 14 a baffle platform having a facetted construction is provided. In FIG. 14 the front surface of the baffle platform has a diamond shape 42 and four (4) facets or faces 44. FIG. 15 shows another embodiment which also shows a faceted type construction. A front rectangular surface 46 is provided in FIG. 15 having four faces or facets 48. FIG. 16 shows still another alternative embodiment in which the baffle platform is composed of an elliptical post having an elliptical front surface 50. It should be understood that other shapes for the front face and surface of the baffle platform are possible for example a gear type surface for interaction with the flowing viscous fluid.

The foregoing is considered as illustrative only to the principles of the invention. Further, since numerous changes and modifications will occur to those skilled in the art, it is not desired to limit the invention to the exact construction and operation shown and described above, and accordingly all suitable modifications and equivalents may be resorted to, falling within the scope of the invention.

We claim:

1. A spray dispenser for dispensing and atomizing liquid comprising:

a) a reservoir for storing a viscous fluid;

b) means to deliver viscous fluid from said reservoir to a delivery passageway;

c) a nozzle in fluid communication with said delivery passageway having a first and second nozzle outlet providing a first and second intersecting stream of viscous fluid exiting from said first and second nozzle outlets;

d) a first and second baffle centrally located within the nozzle between the first and second nozzle outlets;

said first baffle extending across a portion of said first viscous fluid stream; said second baffle extending across a portion of said second fluid stream;

e) said viscous fluid streams intersecting with one another after contacting said baffles;

so that a portion of the flow of the viscous fluid in said first and second viscous fluid streams is disrupted prior to the intersection of the viscous fluid streams.

2. The spray dispenser according to claim 1 wherein the baffles are attached to said nozzle.

3. The spray dispenser according to claim 1 wherein said baffles are integral with said nozzle.

4. The spray dispenser according to claim 1 further comprising:

a third baffle spaced apart from said first and second baffles for contacting said first intersecting stream.

5. The spray dispenser according to claim 4 further comprising:

fourth baffle spaced apart from said first, second and third baffle for contacting said second intersecting stream.

6. The spray dispenser according to claim 5 wherein said first and second intersecting streams having an interior side and an exterior side opposed to said interior side;

said first and second baffles contacting said first and second intersecting streams on the interior sides of said first and second intersecting streams.

7. The spray dispenser according to claim 6 wherein said third and fourth baffles contacting said third and fourth intersecting streams on the exterior sides of said first and second intersecting streams.

8. The spray dispenser according to claim 1 wherein said first and second baffles are provided by opposed surfaces of a post.

9. The spray dispenser according to claim 8 wherein said post has a circular front surface.

10. The spray dispenser according to any one of claims 1–3 and 5–9 wherein the spray dispenser is an aerosol dispenser.

11. The spray dispenser according to any one of claims 1–3 and 5–10 wherein the spray dispenser is a hand pump sprayer.

12. The spray dispenser according to any one claim 1–3 and 5–10 wherein the spray dispenser is an aerosol sprayer having a compressed gas propellent selected from the group consisting of carbon dioxide, nitrogen and nitrous oxide.

13. A spray dispensing system for viscous fluids comprising:

(a) a reservoir;

(b) a viscous fluid composed of vegetable oil or hair spray having a viscosity greater than about 60 cps stored in said reservoir;

(c) means to deliver said viscous fluid from said reservoir to a delivery passageway;

(d) a nozzle having a first and second nozzle outlet providing a first and second intersecting stream of viscous fluid exiting from said first and second nozzle outlets;

(e) a first and second viscous fluid baffle extending across a part of each viscous fluid stream to disrupt a portion of the flow of the viscous fluid in each stream;

(f) said viscous fluid streams intersecting with one another after contacting said baffles;

said first and second viscous fluid baffles centrally located within the nozzle between the first and second nozzle outlet;

said first baffle contacting a portion of said first viscous fluid stream and said second baffle contacting a portion of said second viscous fluid stream;

so that the flow of the viscous liquid in said first and second fluid streams is disrupted prior to the intersection of the viscous fluid streams.

14. The spray dispensing system according to claim 13 wherein the baffle is attached to said nozzle.

15. The spray dispensing system according to claim 13 wherein said baffle is integral with said nozzle.

16. The spray dispensing system according to claim 13 further comprising:

a baffle platform centrally located within the nozzle between the first and second nozzle outlet;

said baffle platform providing a first baffle located on a first exterior surface of said baffle platform and a second baffle located on a second exterior surface of said baffle platform;

said first baffle contacting said first viscous fluid stream and said second baffle contacting said second viscous liquid stream;

whereby the flow of the viscous liquid in said first and second liquid streams are disrupted prior to the intersection of the viscous fluid streams.

17. The spray dispensing system according to claim 13 further comprising;

a third baffle spaced apart from said first and second baffles for contacting said first intersecting stream.

18. The spray dispensing system according to claim 17 further comprising;

a fourth baffle spaced apart from said first, second and third baffles for contacting said second intersecting stream.

19. The spray dispensing system according to claim 18 wherein:

said first and second intersecting streams having an interior side and an exterior side opposed to said interior side;

said first and second baffles contacting said first and second intersecting stream on the interior sides of said first and second intersecting stream.

20. The spray dispensing system according to claim 19 wherein said third and fourth baffles contacting said third and fourth intersecting streams on the exterior sides of said third and fourth intersecting streams.

21. The spray dispensing system according to claim 13 wherein said first and second baffles are providing by a post.

22. The spray dispensing system on claim 21 wherein said baffle platform has a circular front surface.

23. The spray dispensing system according to claim 13 wherein said viscous fluid is a vegetable oil based cooking spray.

24. The spray dispensing system according to claim 23 wherein the dispenser is an aerosol spray dispenser having a compressed gas propellant.

25. The spray dispensing system according to claim 13 wherein said viscous fluid is a hair spray.

26. The spray dispensing system according to claim 13 wherein the spray dispenser is an aerosol dispenser.

27. The spray dispensing system according to claim 13 wherein the spray dispenser is a hand pump sprayer.

28. The spray dispensing system according to claim 13 wherein the viscosity of viscous fluid is from about 60 cps to about 200 cps.

29. The spray dispensing system according to claim 13 wherein the viscosity of viscous fluid is from about 70 cps to 150 cps.

30. The spray dispensing system according to claim 13 wherein the spray dispenser in an aerosol sprayer having a compressed gas propellant selected form the group consisting of carbon dioxide, nitrogen and oxide.

* * * * *